US012765606B2

(12) United States Patent
Wang

(10) Patent No.: US 12,765,606 B2
(45) Date of Patent: Oct. 20, 2026

(54) ADJUSTABLE AEROSOL GENERATION APPARATUS

(71) Applicant: YIBLA (USA) TECHNOLOGY CO., LTD, City Of Industry, CA (US)

(72) Inventor: Guangrui Wang, Puyang (CN)

(73) Assignee: YIBLA (USA) TECHNOLOGY CO., LTD, City of Industry, CA (US)

( * ) Notice: Subject to any disclaimer, the term of this patent is extended or adjusted under 35 U.S.C. 154(b) by 440 days.

(21) Appl. No.: 18/509,649

(22) Filed: Nov. 15, 2023

(65) Prior Publication Data

US 2025/0151798 A1 May 15, 2025

(51) Int. Cl.

| | |
|---|---|
| ***A24F 40/485*** | (2020.01) |
| ***A24F 40/10*** | (2020.01) |
| ***A24F 40/42*** | (2020.01) |
| ***A24F 40/44*** | (2020.01) |
| ***A24F 40/51*** | (2020.01) |
| ***A24F 40/60*** | (2020.01) |

(52) U.S. Cl.

CPC ..... *A24F 40/485* (2020.01); *A24F 40/10* (2020.01); *A24F 40/42* (2020.01); *A24F 40/44* (2020.01); *A24F 40/51* (2020.01); *A24F 40/60* (2020.01)

(58) Field of Classification Search

CPC ..... A24F 40/485; A24F 40/42; A24F 40/51; A24F 40/60

See application file for complete search history.

(56) References Cited

U.S. PATENT DOCUMENTS

2019/0046745 A1* 2/2019 Nettenstrom ..... A61M 15/002

FOREIGN PATENT DOCUMENTS

WO WO-2022238119 A1 * 11/2022 ..... A61M 15/002

* cited by examiner

*Primary Examiner* — Frank J Vineis
*Assistant Examiner* — Laura B Figg
(74) *Attorney, Agent, or Firm* — Getech Law LLC; Jun Ye

(57) ABSTRACT

The present invention relates to an adjustable aerosol generation apparatus, including a suction nozzle, a housing, a liquid storage member, an atomization core, a sealing base, an adjusting member, and a controller. The suction nozzle is connected to the housing, and the housing is provided with a receiving cavity and an air intake hole. The liquid storage member is located in the receiving cavity. The atomization core is located in the liquid storage member. The sealing base covers an end face, opposite to the suction nozzle, of an end of the liquid storage member. The adjusting member is movably disposed on a side, opposite to the liquid storage member, of the sealing base. The controller is electrically connected to the atomization core. When the adjustable aerosol generation apparatus of the present invention is used, the adjusting member is not easily touched, the air intake volume is stable.

20 Claims, 14 Drawing Sheets

ADJUSTABLE AEROSOL GENERATION APPARATUS

TECHNICAL FIELD

The present invention relates to the field of aerosol generation technologies, and in particular to an adjustable aerosol generation apparatus.

BACKGROUND

It has become a common understanding that smoking is harmful to health. As people attach greater importance to health, an aerosol generation apparatus that can suck aerosol of cigarettes and replaces the cigarettes emerges, which is widely applied. An existing aerosol generation apparatus usually includes a housing, a liquid reservoir, an atomization core, a battery, an air flow sensor, and a controller. A top part of the housing is connected to a suction nozzle, a bottom part of the housing is provided with an air intake hole, the liquid reservoir is located in the housing, a liquid adsorbing cotton tube for adsorbing to-be-atomized liquid is inserted into the liquid reservoir. An atomization cavity is formed in the liquid adsorbing cotton tube, the atomization cavity is connected to the air intake hole and the suction nozzle. The atomization core is located in the atomization cavity and connected to the suction nozzle and the air intake hole. The air flow sensor is located at a bottom of the housing, and is configured to detect whether a user sucks.

However, a size of an air intake hole of an existing aerosol generation apparatus is set and cannot be adjusted. In actual use, if the air intake hole is set to be small, the user can easily feel breathless. If the air intake hole is large, it is difficult to trigger the air flow sensor to enable the aerosol generation apparatus to be started. Therefore, to resolve the foregoing technical problem, a person skilled in the art sets an air adjusting structure on a side surface of the housing, and adjusts an air intake volume of an electronic cigarette by using the air adjusting structure. However, in use, a hand needs to hold a housing of the aerosol generation apparatus and easily touches the air adjusting structure, resulting in an unstable air intake volume.

SUMMARY

The present invention is intended to provide an adjustable aerosol generation apparatus with a stable air intake volume.

A solution for resolving the foregoing problem in the present invention is as follows. An adjustable aerosol generation apparatus is constructed. The adjustable aerosol generation apparatus includes a suction nozzle, a housing, a liquid storage member, an atomization core, a sealing base, an adjusting member, and a controller. The suction nozzle is connected to the housing, and a receiving cavity and an air intake hole are disposed in the housing. The liquid storage member is located in the receiving cavity and is configured to store to-be-atomized liquid. The atomization core is located in the liquid storage member and is configured to atomize the to-be-atomized liquid. The sealing base covers an end face, opposite to the suction nozzle, of an end of the liquid storage member, and the sealing base is provided with an air guide hole connected to the atomization core and the air intake hole. The adjusting member is movably disposed on a side, opposite to the liquid storage member, of the sealing base and is configured to adjust an air intake volume of the air guide hole; and the controller is electrically connected to the atomization core.

A beneficial effect of the present invention is as follows. According to the present invention, the sealing base covers the end face, opposite to the suction nozzle, of the liquid storage member, the sealing base is provided with the air guide hole connected to the atomization core and the air intake hole, and the adjusting member is movably disposed on the side, opposite to the liquid storage member, of the sealing base, and is configured to adjust an air intake volume of the air guide hole. Therefore, when air needs to be adjusted, only the adjusting member needs to be pushed at the bottom of the aerosol generation apparatus. Because a limb of the user does not touch the bottom of the aerosol generation apparatus during use, the air intake volume is stable.

BRIEF DESCRIPTION OF DRAWINGS

The following describes the present invention with reference to the accompanying drawings.

DETAILED DESCRIPTION

The following describes the present invention in detail with reference to the accompanying drawings and specific implementation.

Figure 1:
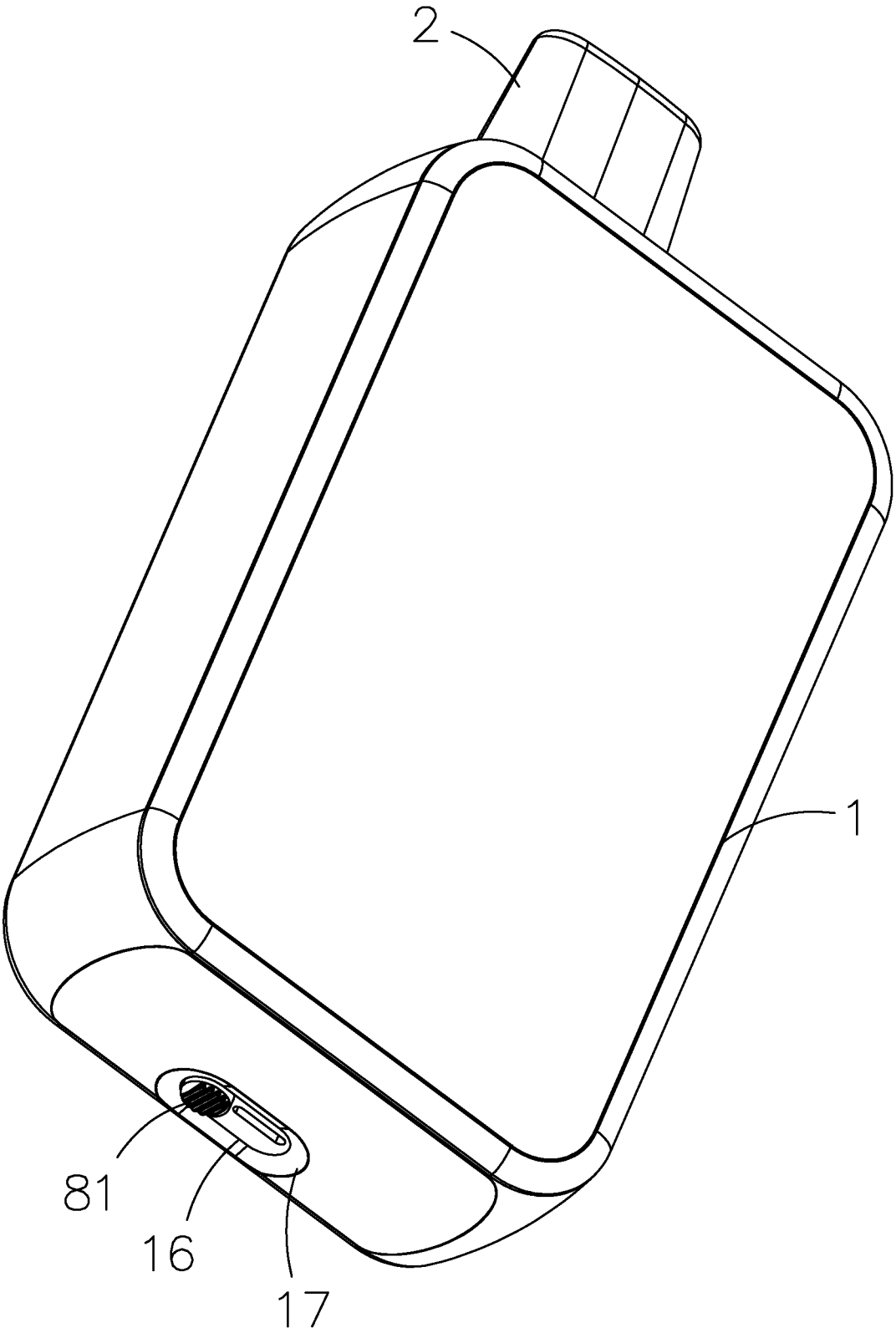
FIG. 1 is a perspective view of an embodiment of an adjustable aerosol generation apparatus according to the present invention.
Figure 2:
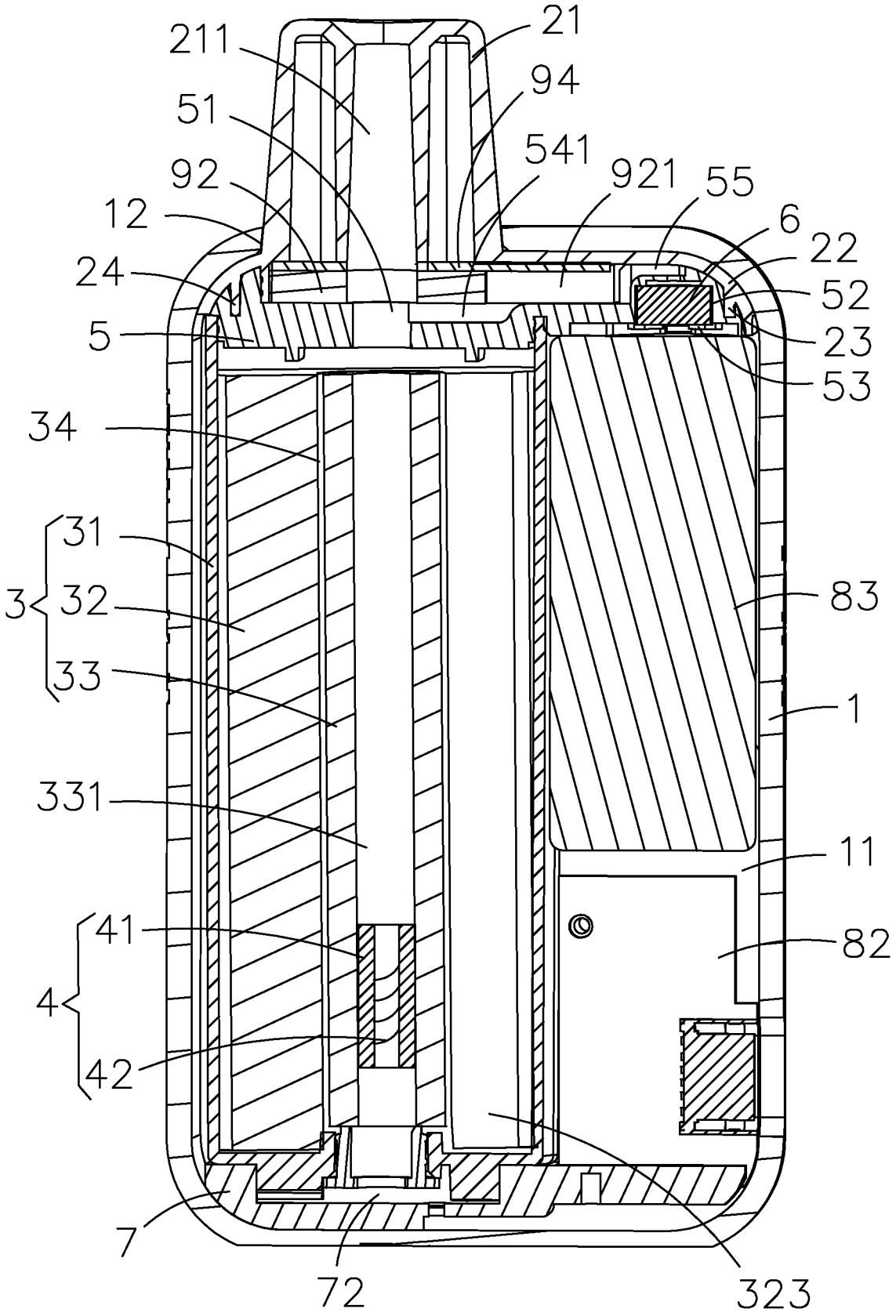
FIG. 2 is a sectional view of the adjustable aerosol generation apparatus shown in FIG. 1.
Figure 3:
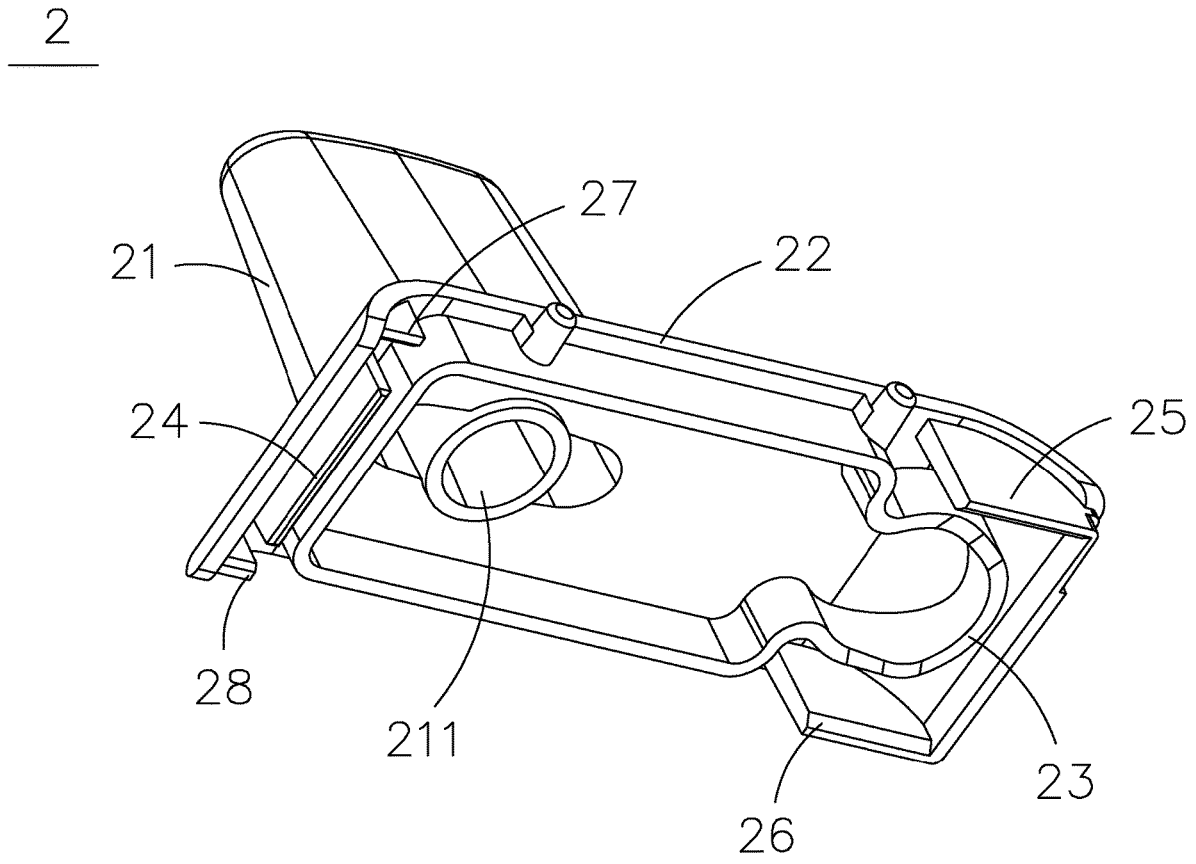
FIG. 3 is a perspective view of a suction nozzle of the adjustable aerosol generation apparatus shown in FIG. 1.

Refer to FIG. 1 to FIG. 3. The present invention provides an adjustable aerosol generation apparatus. The apparatus includes a housing 1, a suction nozzle 2, a liquid storage member 3, an atomization core 4, an elastic sealing top base 5, an air flow sensor 6, a sealing base 7, an adjusting member 81, and a controller 82. The housing 1 is provided with a receiving cavity 11 and a connection hole 12 connected to the receiving cavity 11, and the receiving cavity 11 includes a battery 83. The connection hole 12 is located at a top wall of the housing 1. An air intake hole 16 is disposed at a bottom wall of the housing 1, and the air intake hole 16 is connected to the atomization core 4. An avoidance groove 17 is provided at an air intake orifice of the air intake hole 16 is disposed with, and the avoidance groove 17 is disposed around the air intake orifice.

The suction nozzle 2 is connected to the housing 1. The suction nozzle 2 includes a suction part 21 and a sealing cover part 22. A first end of the suction part 21 is located outside the housing 1. A second end of the suction part 21 extends into the receiving cavity 11 by using the connection hole 12. A smoke outlet hole 211 is disposed in the suction part 21, and smoke formed by atomization of the atomization core 4 is discharged from the smoke outlet hole 211. The sealing cover part 22 is located in the receiving cavity 11 and is connected to the second end of the suction part 21, and an upper surface of the sealing cover part 22 abuts against the housing 1.

The sealing cover part 22 extends toward the elastic sealing top base 5, to form a sealing wall part 23, a positioning wall part 24, a first clamping wall part 25, a second clamping wall part 26, a third clamping wall part 27, and a fourth clamping wall part 28. The first clamping wall part 25 and the second clamping wall part 26 are disposed at an interval at one end of the sealing cover part 22. The positioning wall part 24, the third clamping wall part 27, and the fourth clamping wall part 28 are located at the other end of the sealing cover part 22. The positioning wall part 24 is located between the third clamping wall part 27 and the fourth clamping wall part 28. The sealing wall part 23 is annular, and a smoke inlet orifice of the smoke outlet hole 211 is located space formed by the sealing wall part 23. Therefore, air leakage is avoided well, and sensitivity of inhaling is improved.

Figure 4:
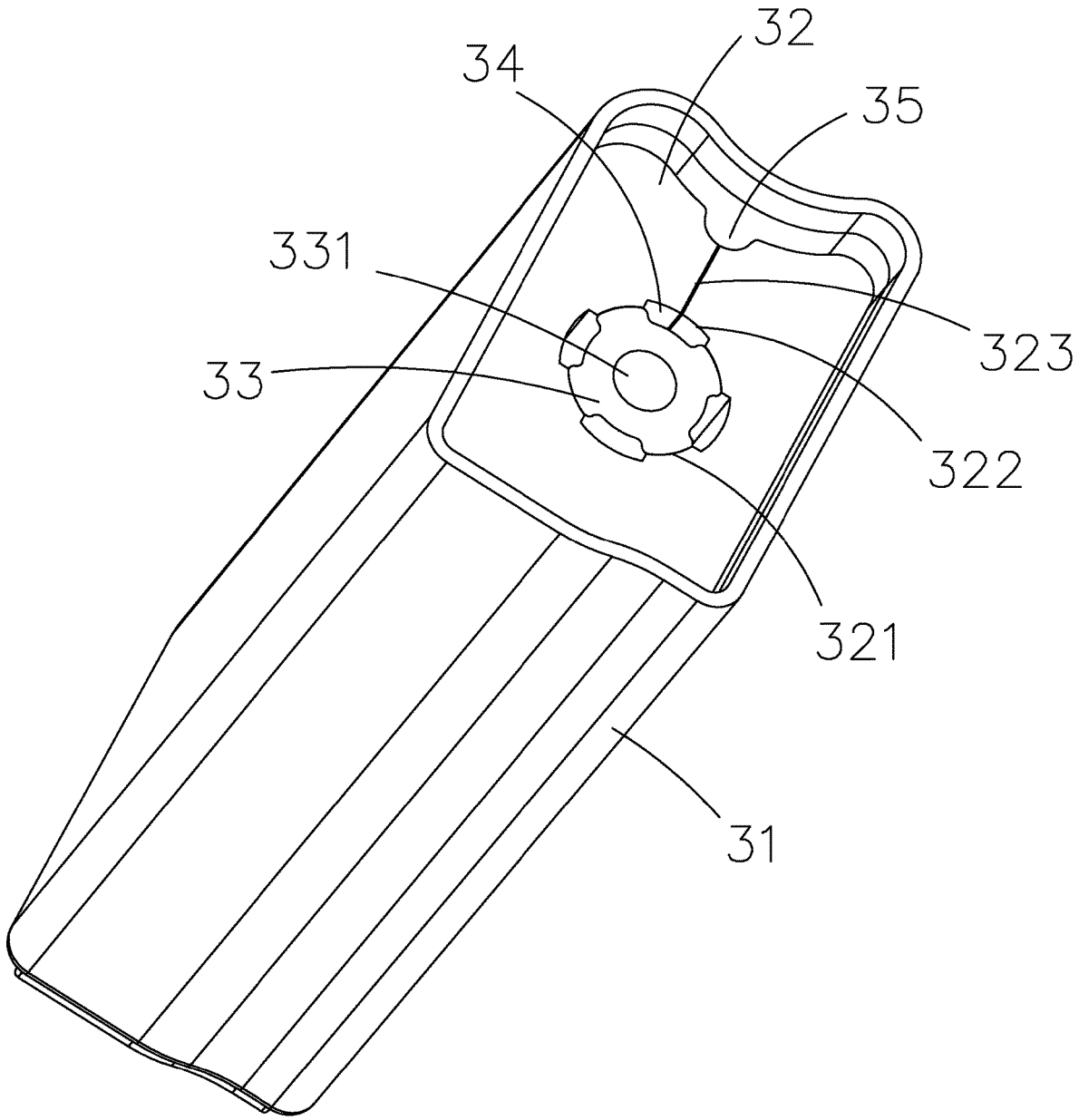
FIG. 4 is a perspective view of a liquid storage member of the adjustable aerosol generation apparatus shown in FIG. 1.
Figure 5:
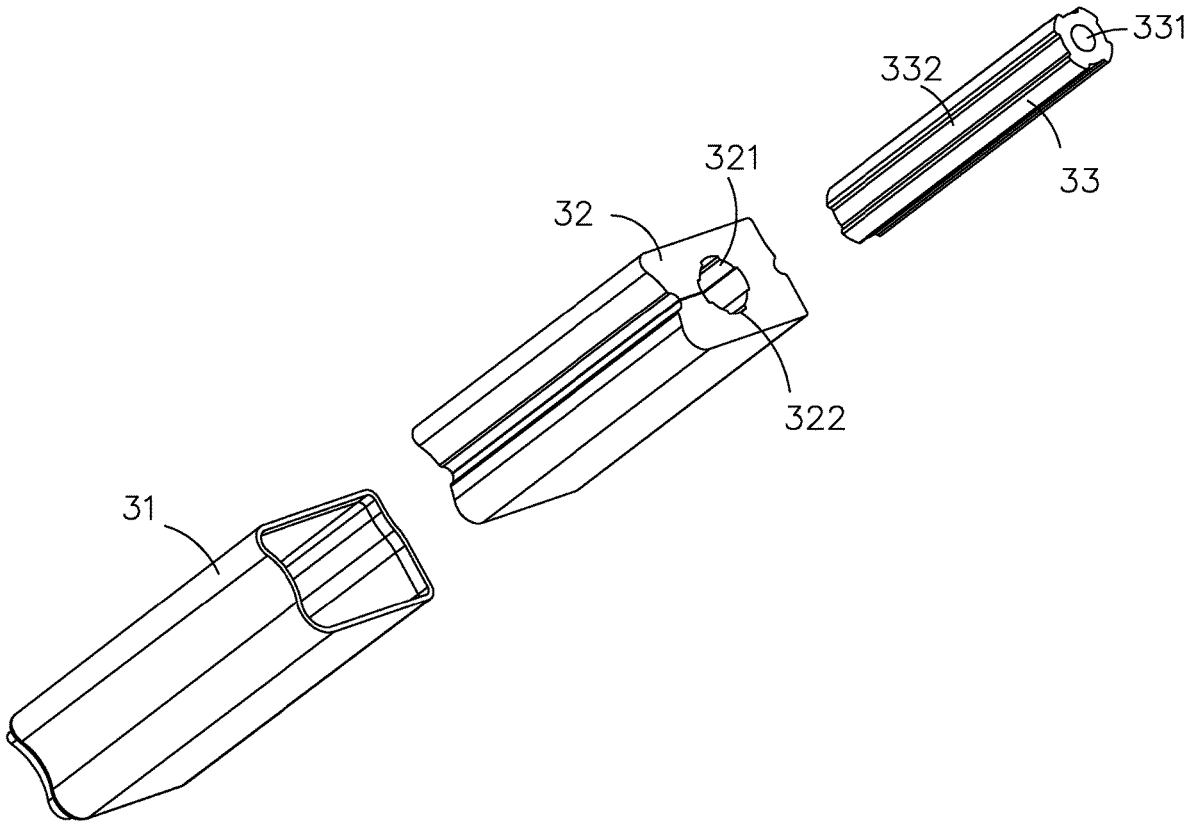
FIG. 5 is an exploded view of the liquid storage member of the adjustable aerosol generation apparatus shown in FIG. 4.

Refer to FIG. 4 and FIG. 5. The liquid storage member 3 includes an accommodating tube 31, a first porous liquid adsorbing tube 32, and a second porous liquid adsorbing tube 33. The accommodating tube 31 is located in the receiving cavity 11 and is disposed in parallel with the battery 83. The first porous liquid adsorbing tube 32 is located in the accommodating tube 31 and is configured to adsorb to-be-atomized liquid. The first porous liquid adsorbing tube 32 is provided with an accommodating cavity 321. The accommodating cavity 321 penetrates end faces of two ends of the first porous liquid adsorbing tube 32. The second porous liquid adsorbing tube 33 is located in the accommodating cavity 321 and in contact with the first porous liquid adsorbing tube 32, to adsorb to-be-atomized liquid from the first porous liquid adsorbing tube 32, and conduct the to-be-atomized liquid to the atomization core 4. The second porous liquid adsorbing tube 33 is provided with an atomization cavity 331 connected to the smoke outlet hole 211. The atomization cavity 331 penetrates end faces of two ends of the second porous liquid adsorbing tube 33.

First pressure relief space 34 is formed between the first porous liquid adsorbing tube 32 and the second porous liquid adsorbing tube 33. The first pressure relief space 34 is connected to the suction nozzle 2 and the air intake hole 16. Specifically, the first pressure relief space 34 is connected to the smoke outlet hole 211 of the suction nozzle 2. Therefore, when the present invention is in an environment in which internal and external air pressures of an aircraft are low, air in the first pressure relief space 34 may be released by the suction nozzle, to avoid leakage of to-be-atomized liquid in the first porous liquid adsorbing tube 32 and the second porous liquid adsorbing tube 33, and avoid liquid leakage. In addition, more to-be-atomized liquid may be injected into the first porous liquid adsorbing tube 32 without worrying about leakage. This may increase an amount of stored liquid stored.

A first end of the first pressure relief space 34 extends into an end face of a first end of the first porous liquid adsorbing tube 32, and a second end of the first pressure relief space 34 extends into an end face of a second end of the first porous liquid adsorbing tube 32. Therefore, in a negative pressure environment, air in the upper end and the lower end of the first porous liquid adsorbing tube 32 and the second porous liquid adsorbing tube 33 may respectively flow toward the upper end and the lower end, to discharge from the suction nozzle 2 and the air intake hole 16, reducing a probability of leakage of the to-be-atomized liquid.

In this embodiment, a first groove 322 extending longitudinally along the first porous liquid adsorbing tube 32 is disposed on a cavity wall of the accommodating cavity 321. The first groove 322 is connected to end faces of two ends of the first porous liquid adsorbing tube 32. The first pressure relief space 34 is formed between a groove wall of the first groove 322 and an outer wall of the second porous liquid adsorbing tube 33. Preferably, a second groove 332 extending longitudinally along the second porous liquid adsorbing tube 33 is disposed on an outer wall of the second porous liquid adsorbing tube 33. The second groove 332 is connected to end faces of two ends of the second porous liquid adsorbing tube 33. The second groove 332 is corresponding to a position of the first groove 322. Therefore, the first pressure relief space 34 is relatively smooth, and is not easily blocked by elastic deformation of the first porous liquid adsorbing tube 32 and the second porous liquid adsorbing tube 33.

The first porous liquid adsorbing tube 32 is provided with a first notch 323 connected to the accommodating cavity 321. The first notch 323 is connected to an outer peripheral surface of the first porous liquid adsorbing tube 32 and the first pressure relief space 34. Therefore, when an external air pressure is low, air in the first pressure relief space 34 may be discharged is more easily, and a probability of leakage of the to-be-atomized liquid is further reduced. Preferably, the first notch 323 extends to end faces of two ends of the first porous liquid adsorbing tube 32, so that the second porous liquid adsorbing tube 33 is easily loaded into the first porous liquid adsorbing tube 32. More preferably, second pressure relief space 35 is formed between the first porous liquid adsorbing tube 32 and the accommodating tube 31. The second pressure relief space 35 extends to end faces of two ends of the first porous liquid adsorbing tube 32 and is connected to the first notch 323. Therefore, it is more advantageous to discharge air when the external air pressure is low, to avoid leakage of the to-be-atomized liquid.

Figure 6:
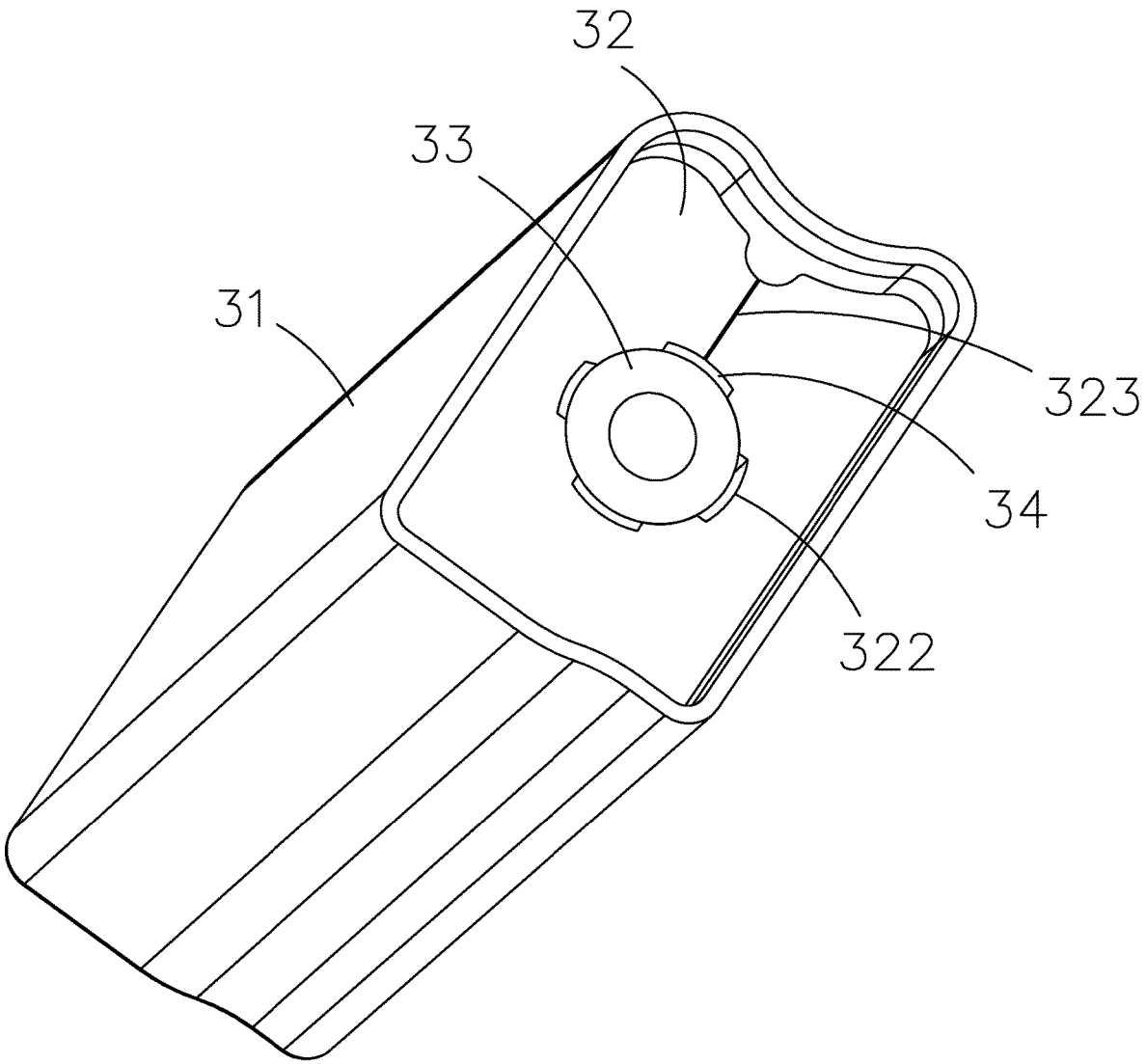
FIG. 6 is a perspective view of another embodiment of a liquid storage member of an adjustable aerosol generation apparatus according to the present invention.
Figure 7:
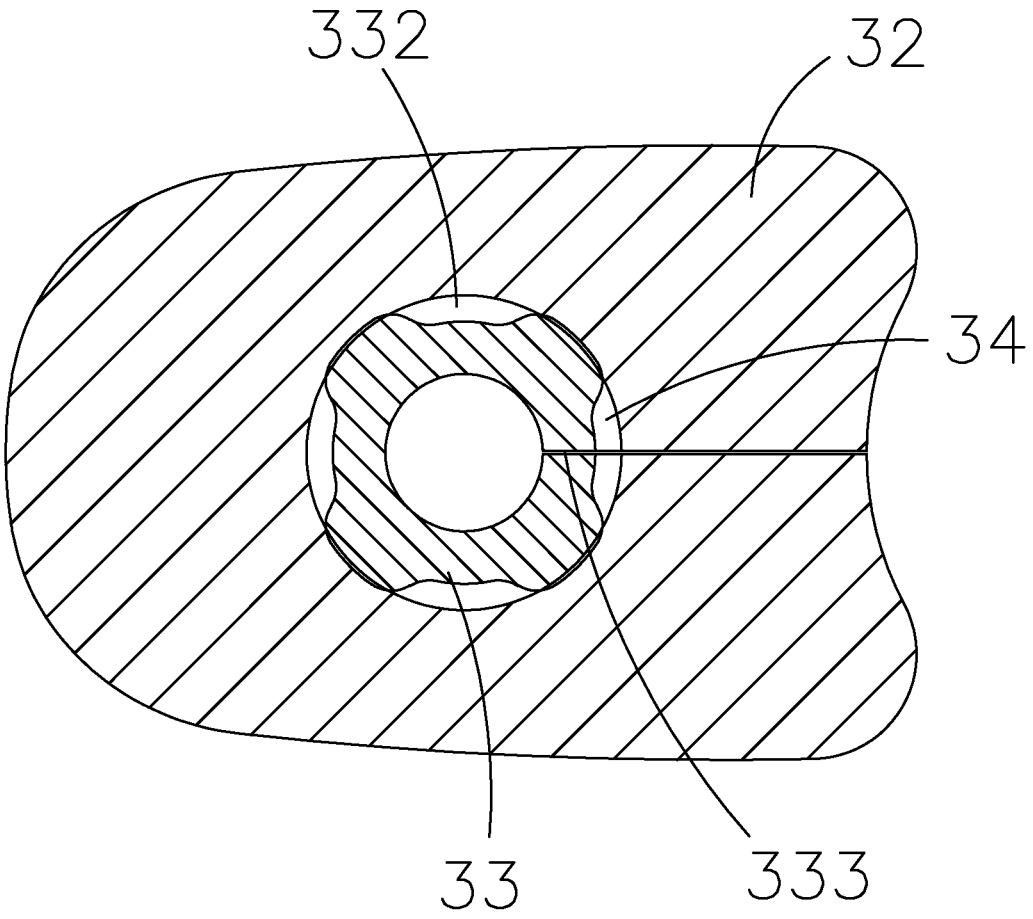
FIG. 7 is a sectional view of cooperation between a first porous liquid adsorbing tube and a second porous liquid adsorbing tube in another embodiment of an adjustable aerosol generation apparatus according to the present invention.
Figure 8:
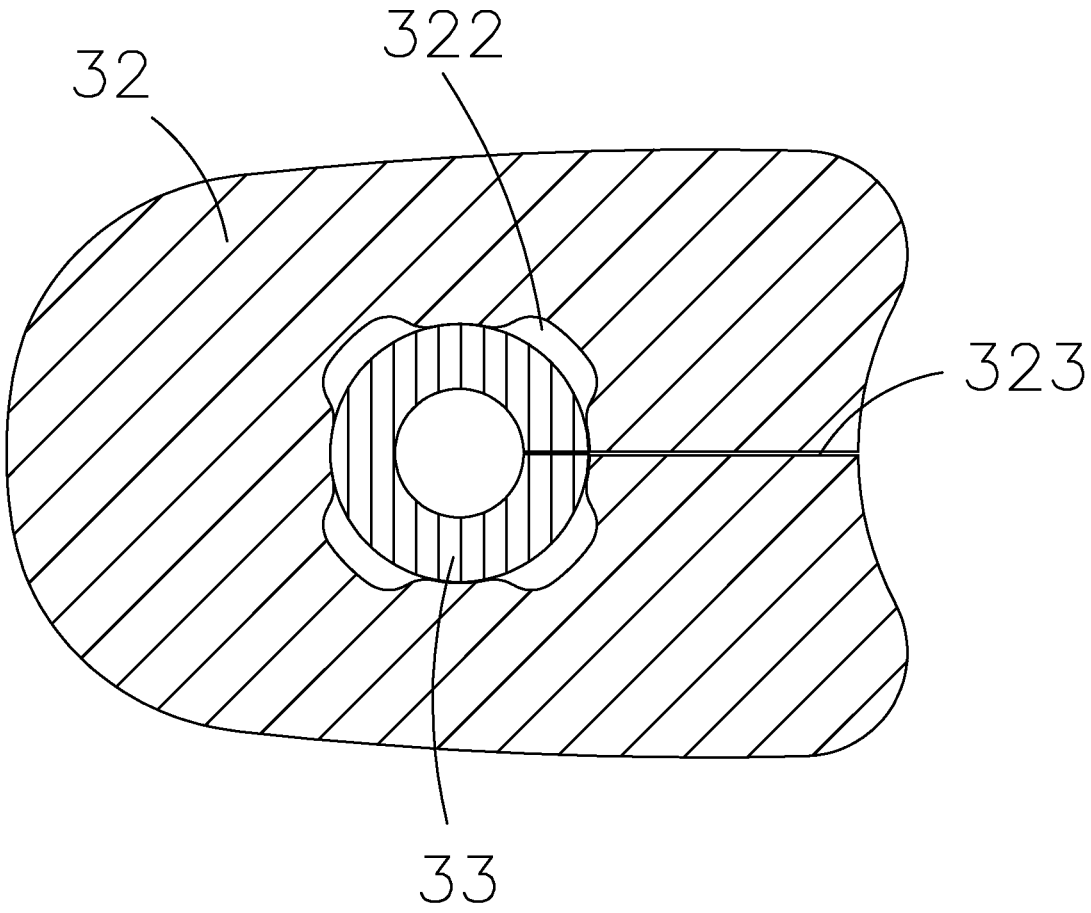
FIG. 8 is a sectional view of cooperation between a first porous liquid adsorbing tube and a second porous liquid adsorbing tube in another embodiment of an adjustable aerosol generation apparatus according to the present invention.

Referring to FIG. 6, in another embodiment, a cross-section of the second porous liquid adsorbing tube 33 is circular, that is, the second groove 332 does not need to be disposed on an outer wall of the second porous liquid adsorbing tube 33. Therefore, during assembly, careful alignment is not required, which facilitates assembly and improves production efficiency. It may be understood that referring to FIG. 7, in another embodiment, the first groove 322 may not be disposed on a cavity wall of the accommodating cavity 321, and the second groove 332 is disposed on an outer wall of the second porous liquid adsorbing tube 33. The first pressure relief space 34 is formed between a groove wall of the second groove 332 and a cavity wall of the accommodating cavity 321. Therefore, a shape and a location of the first pressure relief space 34 are not specifically limited herein. In addition, the second porous liquid adsorbing tube 33 is further provided with a second notch 333. The second notch 333 is connected to an outer peripheral surface of the second porous liquid adsorbing tube 33 and the atomization cavity 331. Therefore, assembly of the atomization core is facilitated. In addition, the second notch 333 is connected to the first pressure relief space 34. Therefore, a path of air flow is added. Referring to FIG. 8, in another embodiment, the second groove 332 does not need to be disposed on the outer wall of the second porous liquid adsorbing tube 33, and only the first groove 322 is disposed on a cavity wall of the accommodating cavity 321. First pressure relief space 34 is formed between a groove wall of the first groove 322 and an outer wall of the second porous liquid adsorbing tube 33.

To adsorb more to-be-atomized liquid and supply liquid to the atomization core 4 timely, a porosity of the first porous liquid adsorbing tube 32 is less than a porosity of the second porous liquid adsorbing tube 33. A cross-sectional area of the first porous liquid adsorbing tube 32 is greater than a cross-sectional area of the second porous liquid adsorbing tube 33. A volume of the first porous liquid adsorbing tube 32 is greater than a volume of the second porous liquid adsorbing tube 33. The first porous liquid adsorbing tube 32 is configured to adsorb a large amount of to-be-atomized liquid. The second porous liquid adsorbing tube 33 adsorbs a small amount of to-be-atomized liquid. Therefore, dry burning can be avoided, liquid leakage can be avoided, and liquid storage can be increased. The first porous liquid adsorbing tube 32 and the second porous liquid adsorbing tube 33 may be made of fiber, a foam material, or the like, as long as the porous liquid adsorbing tube can adsorb the to-be-atomized liquid. A structure of the porous liquid adsorbing tube is not specifically limited herein.

Referring to FIG. 2, the atomization core 4 is located in the atomization cavity 331 and is in contact with the second porous liquid adsorbing tube 33, to atomize to-be-atomized liquid in the second porous liquid adsorbing tube 33. The atomization core 4 includes a liquid adsorbing cotton column 41 and a heating element 42 located in the liquid adsorbing cotton column 41. The liquid adsorbing cotton column 41 contacts the second porous liquid adsorbing tube 33, to adsorb the to-be-atomized liquid at the second porous liquid adsorbing tube 33. The heating element 42 contacts the liquid adsorbing cotton column 41, and is electrically connected to the controller 82, to atomize to-be-atomized liquid in the liquid adsorbing cotton column 41. The heating element 42 may be a heating wire, a heating net, or the like.

Figure 9:
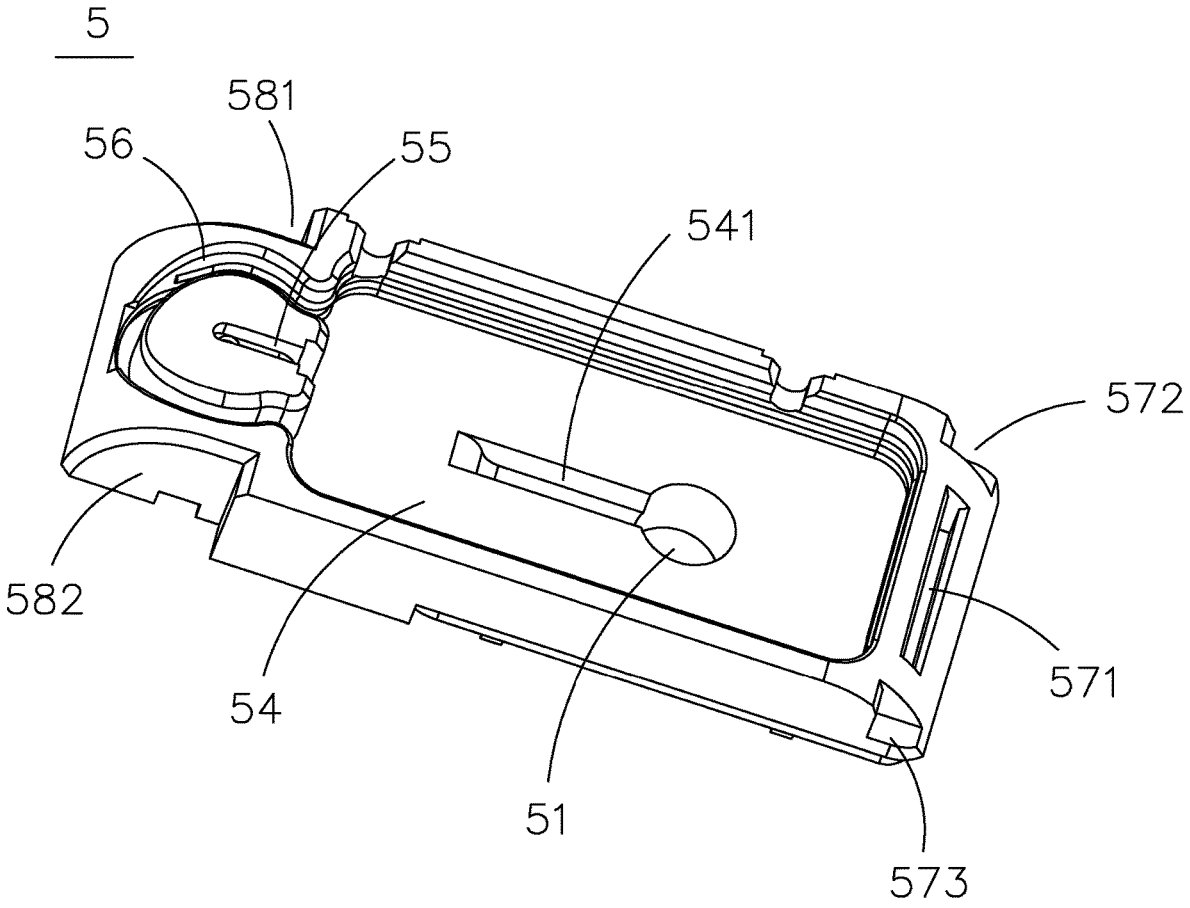
FIG. 9 is a perspective view of the adjustable aerosol generation apparatus shown in FIG. 1 from a view of an elastic sealing top base.
Figure 10:
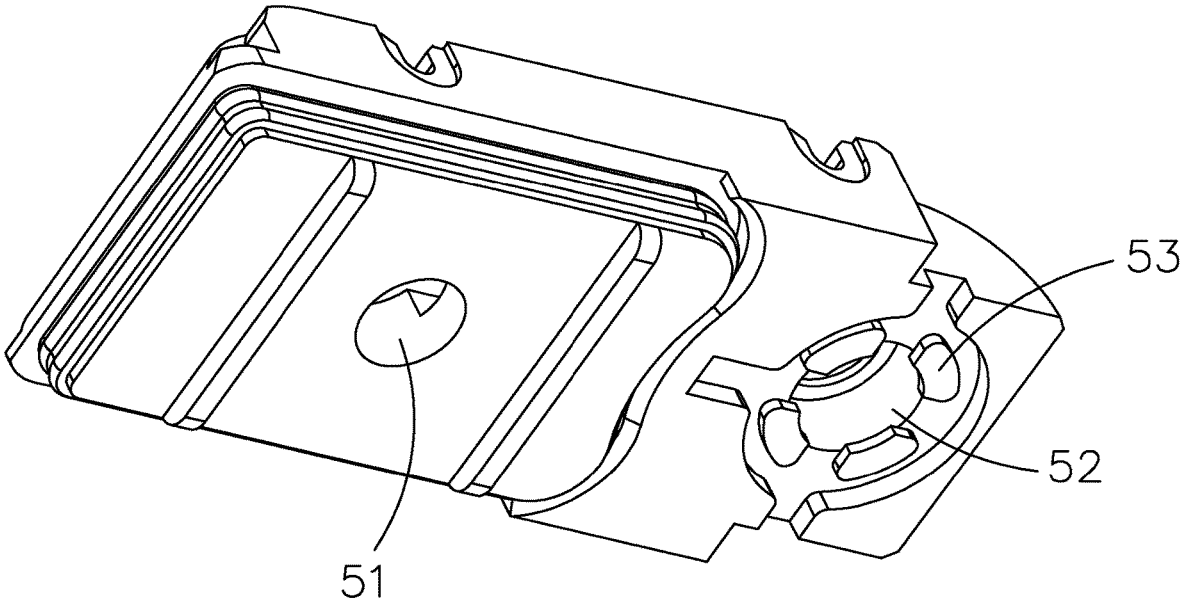
FIG. 10 is a perspective view of the adjustable aerosol generation apparatus shown in FIG. 1 from another view of an elastic sealing top base.

Referring to FIG. 2, FIG. 9, and FIG. 10, the elastic sealing top base 5 is located in the receiving cavity 11, and a first end of the elastic sealing top base 5 covers a tube orifice, facing the suction nozzle 2, of the liquid storage member 3, to seal the tube orifice of the liquid storage member 3. The liquid storage member 3 and the sealing cover part 22 jointly clamp the elastic sealing top base 5, to better avoid air leakage, and improve sensitivity of suction. A smoke discharge hole 51 that is connected to the suction nozzle 2 is disposed at a position at which the elastic sealing top base 5 is corresponding to the tube orifice of the liquid storage member 3. The atomization core 4 is connected to the smoke discharge hole 51. The smoke discharge hole 51 is configured to discharge, to the suction nozzle 2, smoke formed by the to-be-atomized solution in the atomization core 4.

An installation groove 52 is disposed at a second end of the elastic sealing top base 5. The installation groove 52 is located on a lower surface of the second end of the elastic sealing top base 5. The installation groove 52 and the smoke discharge hole 51 are disposed in parallel and at an interval, and are located above the battery 83. A blocking protrusion 53 is disposed at an opening of the installation groove 52. The air flow sensor 6 is located in the installation groove 52 and is connected to the suction part 21. The blocking protrusion 53 is located on a side, opposite to the sealing cover part 22, of the air flow sensor 6, to prevent the air flow sensor 6 from falling. The sealing cover part 22 covers a surface, opposite to the liquid storage member 3, of the elastic sealing top base 5. A sensing airway is formed between the sealing cover part 22 and the elastic sealing top base 5. The air flow sensor 6 is connected to the suction part 21 through the sensing airway.

In addition, an accommodating groove 54, a second air guide groove 55, and a sealing groove 56 are disposed on a surface, facing the suction part 21, of the elastic sealing top base 5. A first air guide groove 541 is disposed on a bottom wall of the accommodating groove 54, and the first air guide groove 541 is connected to the smoke discharge hole 51. The second air guide groove 55 is located on an upper surface of the second end of the elastic sealing top base 5, and is located above the installation groove 52 and connected to the installation groove 52 and the accommodating groove 54. The accommodating groove 54 and the second air guide groove 55 form the sensing airway. The air flow sensor 6 is connected to the suction part 21 by using the second air guide groove 55 and the accommodating groove 54. A lower surface of the sealing cover part 22 abuts against the elastic sealing top base 5 and seals an upper surface of the elastic sealing top base 5. Therefore, sealing of the sensing airway is improved. The sealing groove 56 is disposed around the sensing airway. A sealing wall part 23 is inserted in the sealing groove 56 and is disposed around the sensing airway. Therefore, sealing is better, air leakage is better avoided, and sensitivity of suction is further improved.

A positioning groove 571 is further disposed at the first end of the elastic sealing top base 5. A positioning wall part 24 is inserted into the positioning groove 571, so that a problem of air leakage due to a deviation of the suction nozzle 2 can be avoided. A first side of the first end of the elastic sealing top base 5 is provided with a first clamping groove 572. A second side of a first end of the elastic sealing top base 5 is provided with a second clamping groove 573. The first side of the first end of the elastic sealing top base 5 is disposed opposite to a position of the second side of the first end of the elastic sealing top base 5. The positioning groove 571 is located between the first clamping groove 572 and the second clamping groove 573. A third clamping wall part 27 is inserted into the first clamping groove 572, and a fourth clamping wall part 28 is inserted into the second clamping groove 573. Therefore, it is ensured that the first end of the elastic sealing top base 5 is not easily compressed and deformed, improving sealing performance.

A first clamping notch 581 and a second clamping notch 582 are also disposed at the second end of the elastic sealing top base 5. The sealing groove 56 is located between the first clamping notch 581 and the second clamping notch 582. A first clamping wall part 25 is inserted into the first clamping notch 581, and a second clamping wall part 26 is inserted into the second clamping notch 582. Therefore, it is ensured that the second end of the elastic sealing top base 5 is not easily compressed and deformed, improving sealing performance. It may be understood that the elastic sealing top base 5 may be made of an elastic material such as silicone.

Referring to FIG. 2, the adjustable aerosol generation apparatus further includes a liquor condensate adsorbing sheet 92. The liquor condensate adsorbing sheet 92 is located in the accommodating groove 54 and is configured to adsorb liquor condensate flowing down from the suction part 21, to avoid leakage of the liquor condensate. The liquor condensate adsorbing sheet 92 is provided with a ventilation notch 921. The ventilation notch 921 is connected to the second air guide groove 55 and the first air guide groove 541. A first end of the ventilation notch 921 is connected to the first air guide groove 541, and a second end of the ventilation notch 921 is connected to the installation groove 52 through the second air guide groove 55, that is, the installation groove 52 is connected to the ventilation notch 921 through the second air guide groove 55. A height of a position at which the second air guide groove 55 is located is higher than a height of a position at which the first air guide groove 541 is located. Therefore, even if the liquor condensate adsorbing sheet 92 is excessively saturated, condensed to-be-atomized liquid may be discharged from the second air guide groove 55, and does not flow into the air flow sensor 6. An upper cover of the liquor condensate adsorbing sheet 92 is provided with a sealing sheet 94, to enhance sealing performance.

Figure 11:
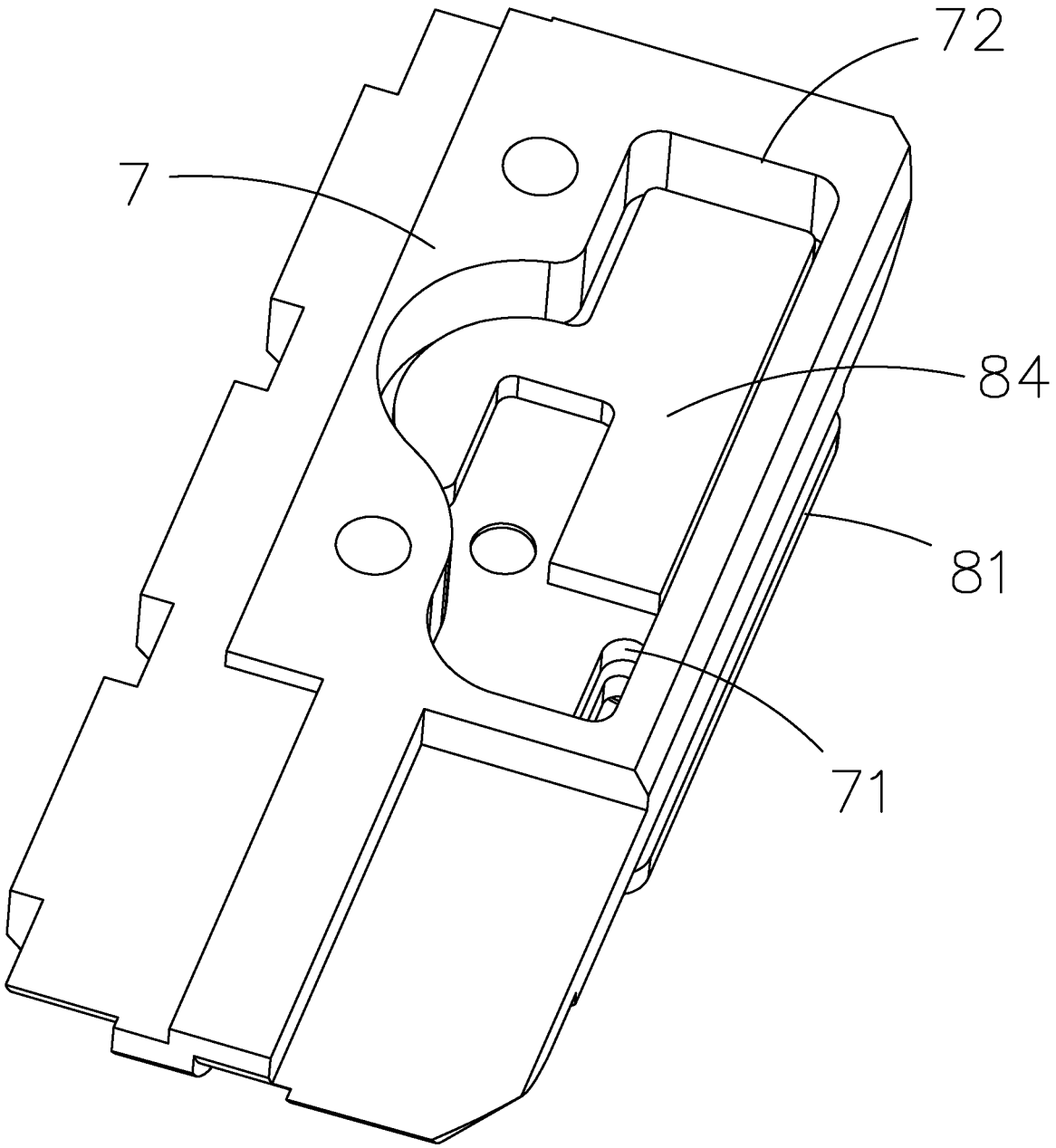
FIG. 11 is a perspective view of cooperation among a sealing base, an adjusting member, and a liquid adsorbing cotton sheet of the adjustable aerosol generation apparatus shown in FIG. 1.
Figure 12:
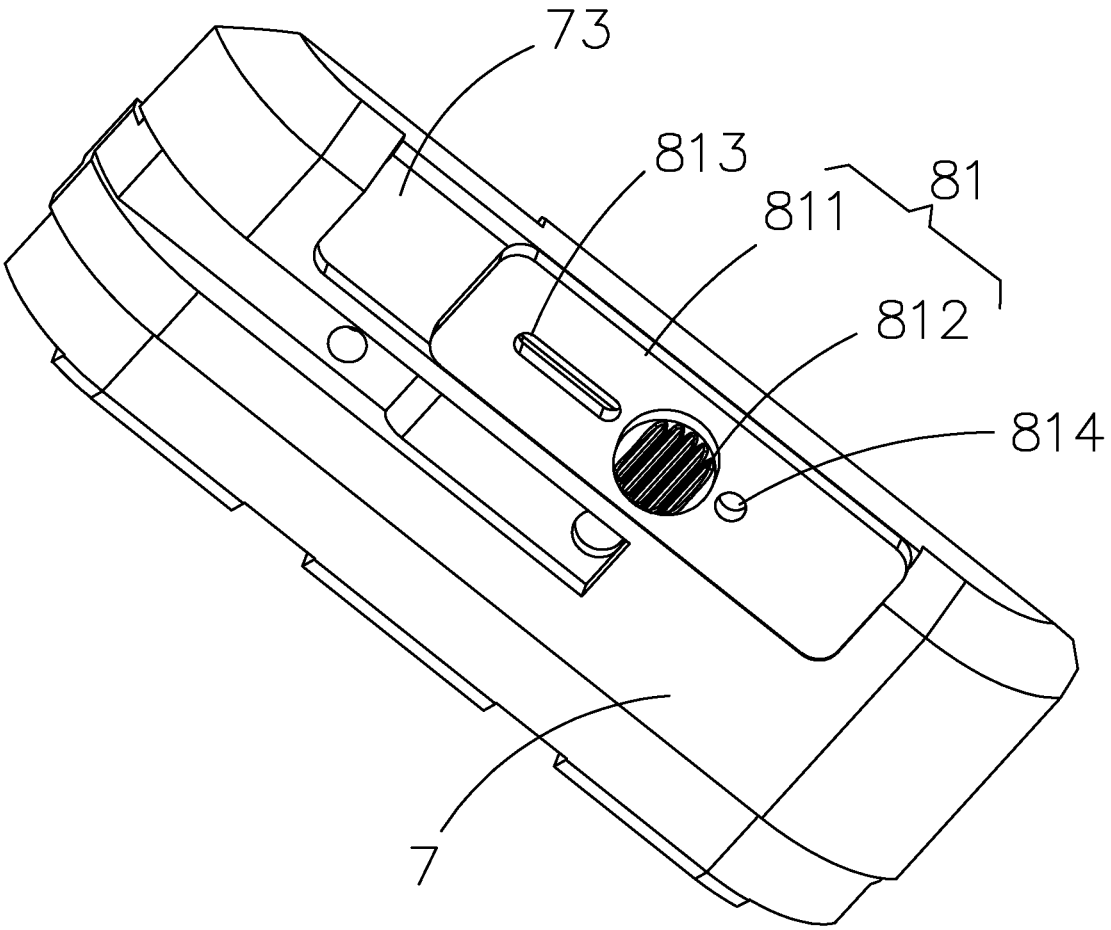
FIG. 12 is a perspective view of cooperation among the sealing base, the adjusting member, and the liquid adsorbing cotton sheet shown in FIG. 11 from another view.

Referring to FIG. 2, FIG. 11, and FIG. 12, a sealing base 7 covers an end face, opposite to the suction nozzle 2, of an end the liquid storage member 3, and the sealing base 7 is provided with an air guide hole 71 connected to the atomization core 4 and the air intake hole 16. A liquid storage tank 72 is further disposed on a surface of the sealing base 7 facing the liquid storage member 3, and a bottom of the liquid storage member 3 is disposed in the liquid storage tank 72, so as to be connected to the sealing base 7. Therefore, the sealing base 7 is provided with good sealing performance and is connected firmly and reliably. A liquid adsorbing cotton sheet 84 is accommodated in a liquid storage tank 72, and the liquid adsorbing cotton sheet 84 is configured to adsorb leaked to-be-atomized liquid. The air guide hole 71 penetrates a groove wall of the liquid storage tank 72, and is connected to the atomization core 4 through the liquid storage tank 72. As a result, the airway is smoother, to prevent noise from being generated when the airway is not tortuous and narrow.

A sliding groove 73 is disposed on one side, opposite to the liquid storage member 3, of the sealing base 7. The air guide hole 71 is disposed in a groove wall of the sliding groove 73. A top wall of the sliding groove 73 is a bottom wall of the liquid storage tank 72, and the air guide hole 71 is located in the groove wall. The adjusting member 81 is movably disposed on a side, opposite to the liquid storage member 3, of the sealing base 7, and is configured to adjust an air intake volume of the air guide hole 71. The adjusting member 81 includes an adjusting sheet 811 and a push/pull protrusion 812. The adjusting sheet 811 is located in the sliding groove 73, and movably covers an orifice of the air guide hole 71. The adjusting sheet 811 can slide along an extension direction of the sliding groove 73 under an action of an external force, to change an air intake area of the orifice of the air guide hole 71.

A first adjusting hole 813 and a second adjusting hole 814 are disposed in the adjusting sheet 811. In a first state, the first adjusting hole 813 is connected to the air guide hole 71, and the second adjusting hole 814 is staggered from the air guide hole 71. In a second state, the first adjusting hole 813 is staggered from the air guide hole 71, and the second adjusting hole 814 is connected to the air guide hole 71. A cross-sectional area of the second adjusting hole 814 is less than a cross-sectional area of the first adjusting hole 813. Therefore, for a user with a small vital capacity, only the present invention needs to be disposed in the second state, so that the second adjusting hole 814 is aligned with and connected to the air guide hole 71, which is easy for the user to use.

The push/pull protrusion 812 is connected to the adjusting sheet 811 and extends into the air intake hole 16. When an air intake volume needs to be adjusted, the air intake volume is changed by pushing the push/pull protrusion 812 to make guide movement along the air intake hole 16, to change an overlapping area between the first adjusting hole 813 and the air guide hole 71. Guided by the air intake hole 16, precise air adjustment can be performed. A length, extending into the air intake hole 16, of the push/pull protrusion 812 is not greater than a depth of the air intake hole 16. Therefore, the adjusting member 81 is preferably prevented from being touched by an external object, and stability of an air intake volume is improved. In addition, an avoidance groove 17 is disposed at an air intake orifice of the air intake hole 16, to help a user's finger to push the push/pull protrusion 812.

Figure 13:
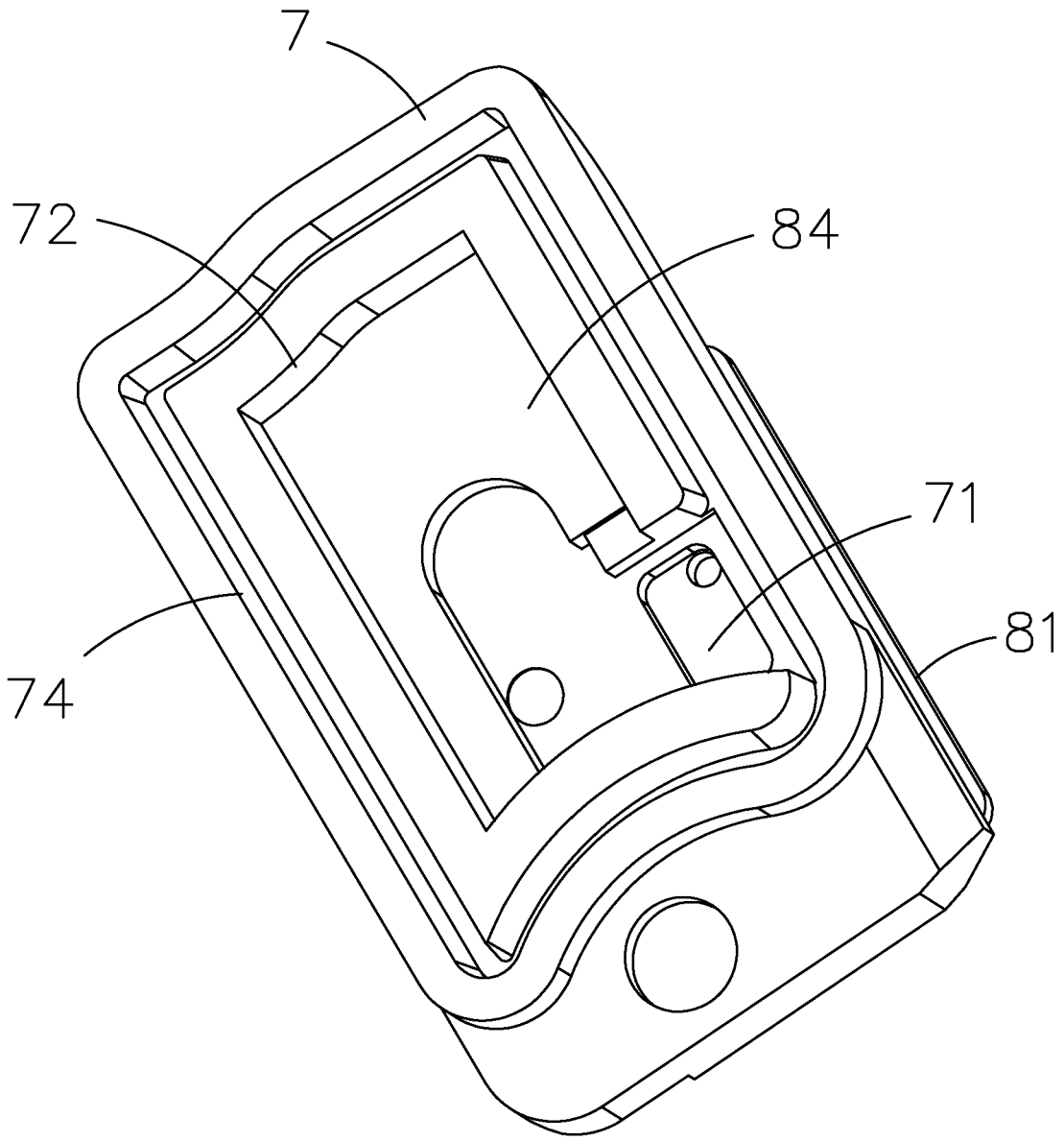
FIG. 13 is a perspective view of cooperation among a sealing base, an adjusting member, and a liquid adsorbing cotton sheet of an adjustable aerosol generation apparatus according to another embodiment of the present invention.
Figure 14:
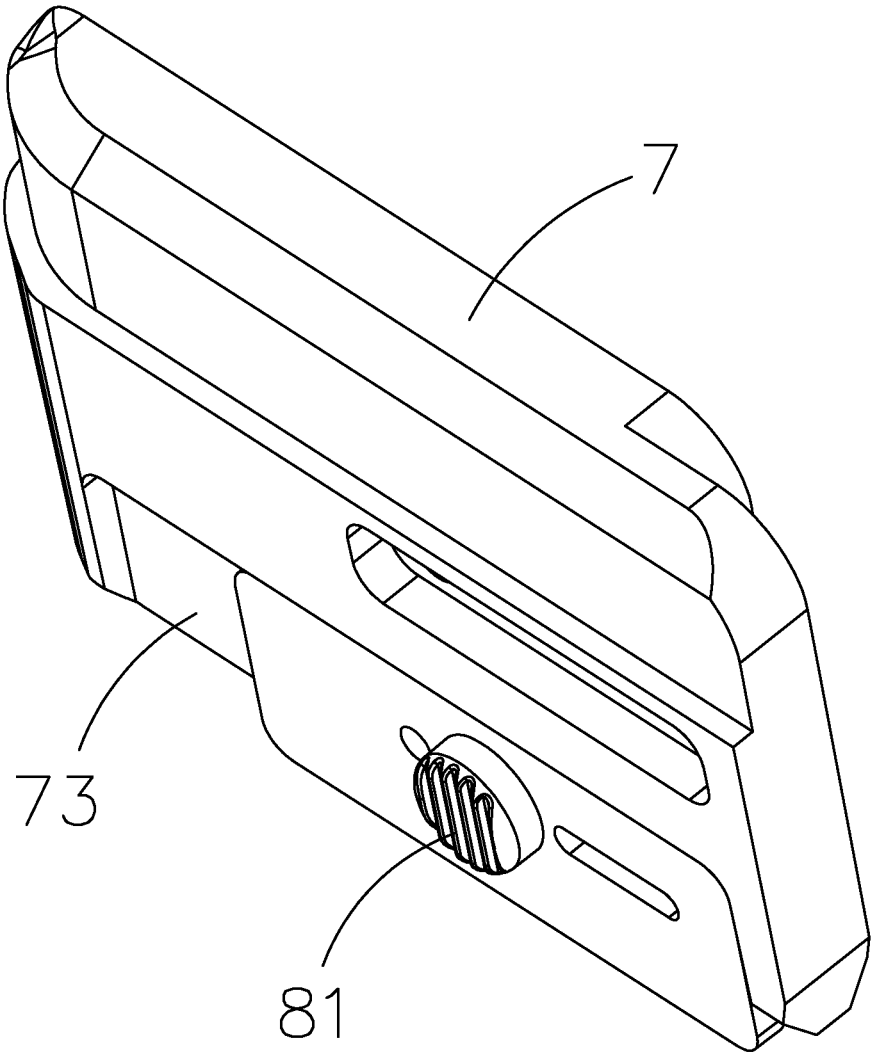
FIG. 14 is a perspective view of cooperation among the sealing base, the adjusting member, and the liquid adsorbing cotton sheet shown in FIG. 13.

Referring to FIG. 13 and FIG. 14, in another embodiment, a connecting groove 74 is further disposed on a surface, facing the liquid storage member 3, of the sealing base 7. The connecting groove 74 is disposed around the liquid storage tank 72. A bottom of the liquid storage member 3 is inserted in the connecting groove 74, to provide a more stable and reliable structure. It may be understood that a manner in which the sealing base 7 is connected to the liquid storage member 3 may be set according to a requirement, which is not specifically limited herein. Referring to FIG. 2, the controller 82 is electrically connected to the air flow sensor 6 and the battery 83. When a user sucks, the air flow sensor 6 triggers the controller 82, and the controller 82 controls the battery 83 to supply power to the atomization core 44, to atomize to-be-atomized liquid.

In conclusion, according to the present invention, the sealing base 7 covers the end face, opposite to the suction nozzle, of the liquid storage member 3, the sealing base 7 is provided with the air guide hole 71 connected to the atomization core 4 and the air intake hole 16, and the adjusting member 81 is disposed on a side, opposite to the liquid storage member 3, of the sealing base 7, and is configured to adjust the air intake volume of the air guide hole 71. Therefore, when air needs to be adjusted, only the adjusting member 81 needs to be pushed at the bottom of the aerosol generation apparatus. Because a limb of the user does not touch the bottom of the aerosol generation apparatus during use, the air intake volume is stable.

It is obvious to a person skilled in the art that the present invention is not limited to details in the foregoing exemplary embodiment, and may be implemented in another specific form without departing from a spirit or a basic characteristic of the present invention. Therefore, from any point of view, the embodiments shall be considered as exemplary and non-limiting, and the scope of the present invention is limited by the appended claims rather than the foregoing description. Therefore, all changes falling within the meaning and scope of the equivalent elements of the claims are intended to be included in the present invention. Any reference numeral in the claims shall not be regarded as limiting the claims to which the reference numeral relate.

In addition, it should be understood that, although the specification is described according to implementations, not every implementation includes only one independent technical solution. The narration mode of the specification is for clarity only. A person skilled in the art should regard the specification as a whole, and technical solutions in embodiments may be properly combined to form another implementation that may be understood by a person skilled in the art.

What is claimed is:

1. An adjustable aerosol generation apparatus, comprising a suction nozzle, a housing, a liquid storage member, an atomization core, a sealing base, and an adjusting member, wherein:

the suction nozzle is connected to the housing, and the housing is provided with a receiving cavity and an air intake hole;

the liquid storage member is located in the receiving cavity and is configured to store to-be-atomized liquid;

the atomization core is located in the liquid storage member and is configured to atomize the to-be-atomized liquid;

the sealing base covers an end face, opposite to the suction nozzle, of an end of the liquid storage member, and an air guide hole connected to the atomization core and the air intake hole is provided at the sealing base;

the adjusting member is movably disposed on a side, opposite to the liquid storage member, of the sealing base and is configured to adjust an air intake volume of the air guide hole;

the adjusting member comprises an adjusting sheet and a push/pull protrusion, and the adjusting sheet is movably covered on an orifice of the air guide hole;

the push/pull protrusion is connected to the adjusting sheet and extends into the air intake hole; and an air intake orifice of the air intake hole is provided with an avoidance groove, and the avoidance groove is disposed around the air intake orifice.

2. The adjustable aerosol generation apparatus according to claim 1, further comprising a controller, wherein the controller is electrically connected to the atomization core, and the air intake hole is disposed at a bottom wall of the housing.

3. The adjustable aerosol generation apparatus according to claim 1, wherein the adjustable aerosol generation apparatus further comprises an elastic sealing top base and a liquor condensate adsorbing sheet, and the housing is provided with a connection hole connected to the receiving cavity;

the suction nozzle comprises a suction part, a first end of the suction part is located outside the housing, and a second end of the suction part extends into the receiving cavity through the connection hole;

the elastic sealing top base covers an end, facing the suction nozzle, of the liquid storage member, and is provided with a smoke discharge hole connected to the suction nozzle;

an accommodating groove is disposed on a surface, facing the suction part, of the elastic sealing top base; and the liquor condensate adsorbing sheet is located in the accommodating groove and is configured to adsorb liquor condensate flowing down from the suction part.

4. The adjustable aerosol generation apparatus according to claim 1, wherein the liquid storage member comprises an accommodating tube and a porous liquid adsorbing tube, the accommodating tube is located in the receiving cavity, and the porous liquid adsorbing tube is located in the accommodating tube;

a pressure relief space is formed between the porous liquid adsorbing tube and the accommodating tube, and the pressure relief space is connected to the suction nozzle; and the porous liquid adsorbing tube is provided with an atomization cavity, and the atomization core is located in the atomization cavity and in contact with the porous liquid adsorbing tube.

5. An adjustable aerosol generation apparatus, comprising a suction nozzle, a housing, a liquid storage member, an atomization core, a sealing base, and an adjusting member, wherein:

the suction nozzle is connected to the housing, and the housing is provided with a receiving cavity and an air intake hole;

the liquid storage member is located in the receiving cavity and is configured to store to-be-atomized liquid;

the atomization core is located in the liquid storage member and is configured to atomize the to-be-atomized liquid;

the sealing base covers an end face, opposite to the suction nozzle, of an end of the liquid storage member, and an air guide hole connected to the atomization core and the air intake hole is provided at the sealing base;

the adjusting member is movably disposed on a side, opposite to the liquid storage member, of the sealing base and is configured to adjust an air intake volume of the air guide hole;

the adjusting member comprises an adjusting sheet and a push/pull protrusion, and the adjusting sheet is movably covered on an orifice of the air guide hole;

the push/pull protrusion is connected to the adjusting sheet and extends into the air intake hole; and a sliding groove is disposed on a side, opposite to the liquid storage member of the sealing base, the air guide hole is disposed at a groove wall of the sliding groove, and the adjusting sheet is located in the sliding groove.

6. The adjustable aerosol generation apparatus according to claim 5, wherein the adjusting sheet is provided with a first adjusting hole, and in a first state, the first adjusting hole is connected to the air guide hole; and in a second state, the first adjusting hole is staggered from the air guide hole.

7. The adjustable aerosol generation apparatus according to claim 6, wherein the adjusting sheet is further provided with a second adjusting hole, and in the first state, the second adjusting hole is staggered from the air guide hole; in the second state, the second adjusting hole is connected to the air guide hole; and a cross-sectional area of the second adjusting hole is less than a cross-sectional area of the first adjusting hole.

8. The adjustable aerosol generation apparatus according to claim 5, wherein the liquid storage member comprises an accommodating tube, a first porous liquid adsorbing tube, and a second porous liquid adsorbing tube, the accommodating tube is located in the receiving cavity, the first porous liquid adsorbing tube is located in the accommodating tube, and the first porous liquid adsorbing tube is provided with an accommodating cavity; and the second porous liquid adsorbing tube is located in the accommodating cavity and in contact with the first porous liquid adsorbing tube, the second porous liquid adsorbing tube is provided with an atomization cavity, a first pressure relief space is formed between the first porous liquid adsorbing tube and the second porous liquid adsorbing tube, and the first pressure relief space is connected to the suction nozzle; and the atomization core is located in the atomization cavity and in contact with the second porous liquid adsorbing tube, to atomize the to-be-atomized liquid at the second porous liquid adsorbing tube.

9. The adjustable aerosol generation apparatus according to claim 8, wherein a first end of the first pressure relief space extends into an end face of a first end of the first porous liquid adsorbing tube, and a second end of the first pressure relief space extends into an end face of a second end of the first porous liquid adsorbing tube.

10. The adjustable aerosol generation apparatus according to claim 8, wherein a cavity wall of the accommodating cavity is provided with a first groove extending longitudinally along the first porous liquid adsorbing tube, the first groove is connected to end faces of two ends of the first porous liquid adsorbing tube, and the first pressure relief space is formed between a groove wall of the first groove and an outer wall of the second porous liquid adsorbing tube; or an outer wall of the second porous liquid adsorbing tube is provided with a second groove extending longitudinally along the second porous liquid adsorbing tube, the second groove is connected to end faces of two ends of the second porous liquid adsorbing tube, and the first pressure relief space is formed between a groove wall of the second groove and a cavity wall of the accommodating cavity.

11. The adjustable aerosol generation apparatus according to claim 8, wherein the first porous liquid adsorbing tube is provided with a first notch connected to the accommodating cavity, and the first notch is connected to an outer peripheral surface of the first porous liquid adsorbing tube and the first pressure relief space.

12. The adjustable aerosol generation apparatus according to claim 8, wherein the second porous liquid adsorbing tube is provided with a second notch, and the second notch is connected to an outer peripheral surface of the second porous liquid adsorbing tube and the atomization cavity; and the second notch is connected to the first pressure relief space.

13. The adjustable aerosol generation apparatus according to claim 11, wherein a second pressure relief space is formed between the first porous liquid adsorbing tube and the accommodating tube; and the second pressure relief space extends to end faces of two ends of the first porous liquid adsorbing tube and is connected to the first notch.

14. The adjustable aerosol generation apparatus according to claim 8, wherein a porosity of the first porous liquid adsorbing tube is less than a porosity of the second porous liquid adsorbing tube; and a cross-sectional area of the first porous liquid adsorbing tube is greater than a cross-sectional area of the second porous liquid adsorbing tube, and a volume of the first porous liquid adsorbing tube is greater than a volume of the second porous liquid adsorbing tube.

15. The adjustable aerosol generation apparatus according to claim 5, wherein the adjustable aerosol generation apparatus further comprises an elastic sealing top base and an air flow sensor, and the housing is provided with a connection hole connected to the receiving cavity; the suction nozzle comprises a suction part and a sealing cover part, a first end of the suction part is located outside the housing, a second end of the suction part extends into the receiving cavity through the connection hole, the sealing cover part is located in the receiving cavity and is connected to the second end of the suction part, and the sealing cover part extends toward the elastic sealing top base to form an annular sealing wall part;

a first end of the elastic sealing top base covers a tube orifice, facing the suction nozzle, of the liquid storage member, and is provided with a smoke discharge hole connected to the suction nozzle, a second end of the elastic sealing top base is provided with an installation groove, the installation groove is disposed in parallel with the smoke discharge hole, and a surface, facing the sealing cover part, of the elastic sealing top base is provided with a sealing groove;

the sealing cover part covers a surface, opposite to the liquid storage member, of the elastic sealing top base, a sensing airway connected to the installation groove is formed between the sealing cover part and the elastic sealing top base, the sealing groove is disposed around the sensing airway, and the sealing wall part is inserted in the sealing groove and disposed around the sensing airway; the atomization core is connected to the smoke discharge hole; and the air flow sensor is located in the installation groove, and the air flow sensor is connected to the suction part through the sensing airway.

16. The adjustable aerosol generation apparatus according to claim 5, further comprising a controller, wherein the controller is electrically connected to the atomization core, and the air intake hole is disposed at a bottom wall of the housing.

17. The adjustable aerosol generation apparatus according to claim 5, wherein the adjustable aerosol generation apparatus further comprises an elastic sealing top base and a liquor condensate adsorbing sheet, and the housing is provided with a connection hole connected to the receiving cavity;

the suction nozzle comprises a suction part, a first end of the suction part is located outside the housing, and a second end of the suction part extends into the receiving cavity through the connection hole;

the elastic sealing top base covers an end, facing the suction nozzle, of the liquid storage member, and is provided with a smoke discharge hole connected to the suction nozzle;

an accommodating groove is disposed on a surface, facing the suction part, of the elastic sealing top base; and the liquor condensate adsorbing sheet is located in the accommodating groove and is configured to adsorb liquor condensate flowing down from the suction part.

18. An adjustable aerosol generation apparatus, comprising a suction nozzle, a housing, a liquid storage member, an atomization core, a sealing base, and an adjusting member, wherein:

the suction nozzle is connected to the housing, and the housing is provided with a receiving cavity and an air intake hole;

the liquid storage member is located in the receiving cavity and is configured to store to-be-atomized liquid;

the atomization core is located in the liquid storage member and is configured to atomize the to-be-atomized liquid;

the sealing base covers an end face, opposite to the suction nozzle, of an end of the liquid storage member, and an air guide hole connected to the atomization core and the air intake hole is provided at the sealing base;

the adjusting member is movably disposed on a side, opposite to the liquid storage member, of the sealing base and is configured to adjust an air intake volume of the air guide hole; and a bottom of the liquid storage member is connected to the sealing base by insertion; and a liquid storage tank is disposed on a surface, facing the liquid storage member, of the sealing base, a liquid adsorbing cotton sheet is accommodated in the liquid storage tank, and the air guide hole penetrates a groove wall of the liquid storage tank and is connected to the atomization core by using the liquid storage tank.

19. The adjustable aerosol generation apparatus according to claim 18, further comprising a controller, wherein the controller is electrically connected to the atomization core, and the air intake hole is disposed at a bottom wall of the housing;

the adjusting member comprises an adjusting sheet and a push/pull protrusion, and the adjusting sheet is movably covered on an orifice of the air guide hole; and the push/pull protrusion is connected to the adjusting sheet and extends into the air intake hole.

20. The adjustable aerosol generation apparatus according to claim 18, wherein the liquid storage member comprises an accommodating tube and a porous liquid adsorbing tube, the accommodating tube is located in the receiving cavity, and the porous liquid adsorbing tube is located in the accommodating tube;

a pressure relief space is formed between the porous liquid adsorbing tube and the accommodating tube, and the pressure relief space is connected to the suction nozzle; and the porous liquid adsorbing tube is provided with an atomization cavity, and the atomization core is located in the atomization cavity and in contact with the porous liquid adsorbing tube.

* * * * *